United States Patent [19]

Ames et al.

[11] Patent Number: 4,751,968

[45] Date of Patent: Jun. 21, 1988

[54] WELLHEAD STABILIZING MEMBER WITH DEFLECTING RIBS

[75] Inventors: Thomas J. Ames, Cypress; Carl F. Boehm, Jr., Houston, both of Tex.

[73] Assignee: Hughes Tool Company, Houston, Tex.

[21] Appl. No.: 940,875

[22] Filed: Dec. 10, 1986

[51] Int. Cl.[4] ..... E21B 33/035

[52] U.S. Cl. ..... 166/368; 166/85; 166/206; 166/379; 166/382; 285/141; 285/382

[58] Field of Search ..... 166/355, 368, 345, 341, 166/348, 359, 382, 85, 88, 213, 214, 206, 207, 378, 379; 285/140–143, 382, 382.5, 382.7

[56] References Cited

U.S. PATENT DOCUMENTS

| | | | |
|---|---|---|---|
| 2,006,793 | 8/1935 | Suter . | |
| 2,134,311 | 10/1938 | Minor et al. . | |
| 2,195,871 | 4/1940 | Kuster . | |
| 2,769,655 | 11/1956 | Holmes . | |
| 3,065,807 | 11/1962 | Wells | 175/321 |
| 3,272,539 | 9/1966 | Asbury, Sr. | 285/332.4 |
| 3,847,215 | 11/1974 | Herd | 166/348 X |
| 4,241,789 | 12/1980 | Grosch | 166/241 |
| 4,468,055 | 8/1984 | Reimert | 285/141 |
| 4,499,950 | 2/1985 | Watkins | 166/285 |
| 4,515,400 | 5/1985 | Smith et al. | 285/141 |
| 4,595,053 | 6/1986 | Watkins et al. | 285/141 X |
| 4,641,708 | 2/1987 | Wightman | 166/208 |

*Primary Examiner*—Jerome Massie
*Assistant Examiner*—Hoang C. Dang
*Attorney, Agent, or Firm*—James E. Bradley

[57] ABSTRACT

A metal support ring is located between a housing and a wellhead for reducing bending movement of the wellhead relative to the housing. The support ring has a plurality of circumferentially extending ribs for engaging the bore of the housing. The ribs are parallel to and vertically spaced apart from each other. Each rib protrudes outwardly from the wellhead a distance greater than the inner diameter of the housing. This causes the ribs to deflect in an interference fit when the wellhead is inserted into the housing.

6 Claims, 3 Drawing Sheets

WELLHEAD STABILIZING MEMBER WITH DEFLECTING RIBS

BACKGROUND OF THE INVENTION

1. Field of the Invention:

This invention relates in general to subsea well assemblies, and in particular to means for reducing rocking movement between a wellhead and a wellhead housing, and thereby increasing the ability to transfer wellhead loads to the wellhead housing.

2. Description of the Prior Art:

In a subsea oil and gas well of the type concerned herein, a template is located on the sea floor. A wellhead housing is cemented into the sea floor and locates in the template. The wellhead housing is a large tubular member secured on its lower end to a large diameter conductor pipe that extends down into the sea floor a selected distance. A wellhead is lowered into the wellhead housing. The wellhead has on its lower end casing which extends down to a greater depth. The upper end is adapted to receive riser conduit that extends to the surface.

The riser conduit is subject to rocking movement due to movement of the vessel overhead and also wave action and currents. This rocking movement can extend downward into the wellhead. The wellhead will have a clearance between its outer wall and the bore of the wellhead housing. The rocking movement causes the wellhead to rock or bend relative to the wellhead housing. There is a lack of any rigid support between the wellhead and the housing resulting in an area in the wellhead where fatigue failure may occur.

There have been proposals to support the wellhead in the housing in a manner such that any bending forces are transmitted to the housing, reducing the rocking movement of the wellhead in the housing. One such proposal is shown in U.S. Pat. No. 4,499,950, Bruce J. Watkins, Feb. 19, 1985. While this patent and proposal is feasible, improvements are desired.

SUMMARY OF THE INVENTION

In this invention, upper and lower supports are located between the wellhead and the housing for transmitting bending forces to the housing. The lower support is a metal stabilizing member. This stabilizing member is carried by the wellhead for engaging the bore of the housing.

The stabilizing member has a plurality of circumferentially extending ribs. The ribs are parallel and vertically spaced apart from each other. Each rib protrudes outward from the wellhead a distance greater than the inner diameter of the housing when the wellhead is seated in the housing. This causes the ribs to deflect in an interference fit when the wellhead is inserted into the housing.

The upper and lower supports are retained in such a

DESCRIPTION OF THE PREFERRED EMBODIMENT

Figure 1:
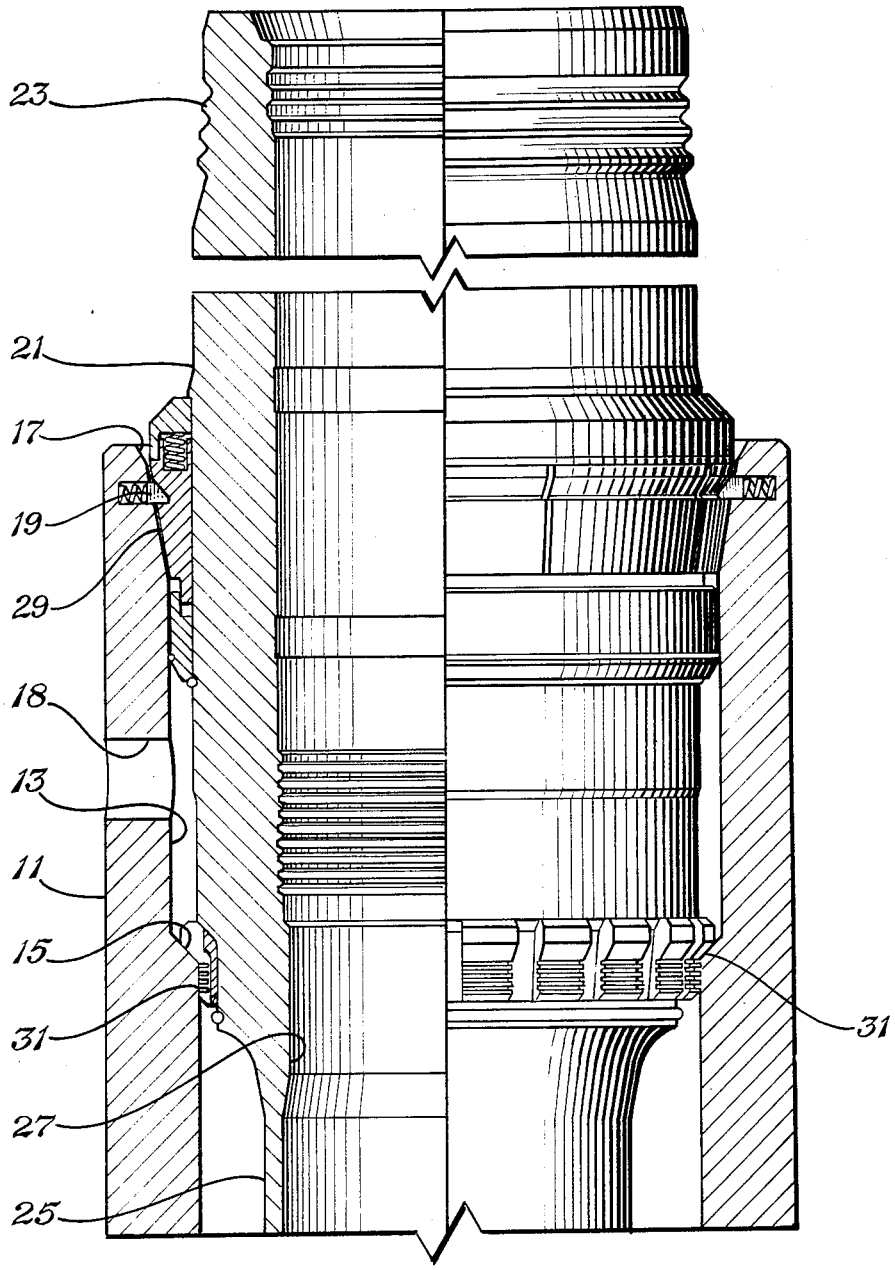

Referring to FIG. 1, the subsea well assembly includes a tubular wellhead housing 11 located on the sea floor. Housing 11 has an internal bore 13 extending therethrough. Bore 13 has a landing shoulder 15 located in it that is frusto-conical and faces upwardly. A plurality of small parallel grooves or wickers 16 (FIG. 2) are located directly below shoulder 15. A conical surface 17 is located on the upper edge of the bore 13. A spring-biased latch 19 is located in the conical surface 17 and faces inwardly. A port 18 extends through the sidewall of the housing 11.

A wellhead 21 is adapted to be lowered into the housing 11. The wellhead 21 lands on the landing shoulder 15. Wellhead 21 is a tubular member having grooves 23 on the upper exterior. The grooves 23 are adapted to be engaged by a connector member (not shown) located on the lower end of riser conduit (not shown) that extends to the surface. Casing 25 is secured to the lower end of the wellhead 21 and extends into the well. Wellhead 21 has a bore 27 extending therethrough. Subsequently, smaller diameter casing (not shown) will be landed in the bore 27 and will extend to even greater depths than the casing 25.

The outer diameter of the wellhead 21 is less than the bore 13 of the housing 11. An upper support means 29 and a lower support means 31 are located in the clearance between the wellhead 21 and the housing bore 13. The support means 29 and 31 transmit bending forces due to lateral movement of the riser (not shown) from the wellhead 21 to the housing 11.

Figure 2:
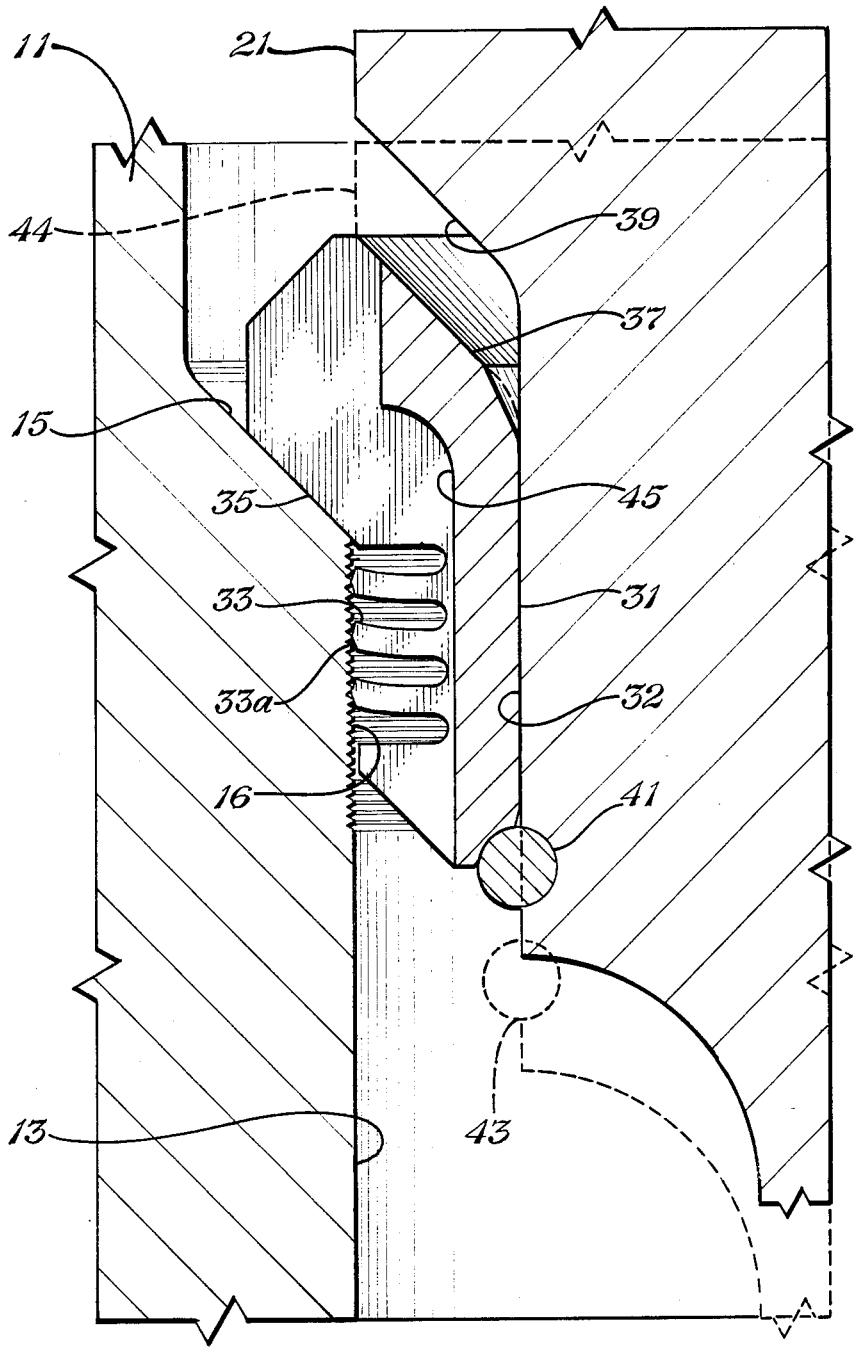
FIG. 2 is an enlarged partial sectional view of the lower support shown in FIG. 1.
Figure 3:
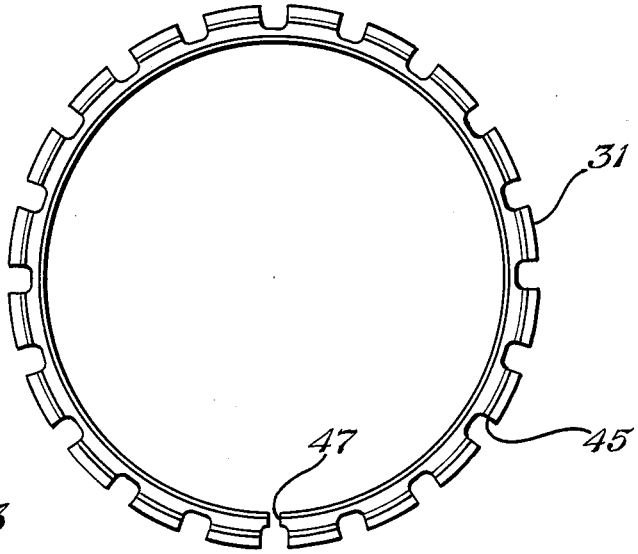
FIG. 3 is a reduced top view of the lower support of FIG. 2.

Referring to FIGS. 2 and 3, the lower support means 31 comprises a metal support ring, preferably constructed of steel. Support ring 31 is an annular split ring. It locates on a cylindrical portion 32 formed on the exterior of the wellhead 21.

The support ring 31 has an inner hub and a plurality of parallel circumferentially extending ribs 33 protruding therefrom. Each rib 33 has an outer edge that is cylindrical and is of the same diameter as each of the other ribs. The outer edge of each rib 33 has a greater diameter than the inner diameter of the housing bore 13 at the point where the ribs 33 engage the bore 13. The point of engagement is immediately below the shoulder 15 in interferring contact with the wickers 16. The greater diameter is only a slight amount, but is sufficient to cause the ribs 33 to deflect overcenter when the wellhead 21 is lowered into the housing 11, because of the weight of the casing 25 (FIG. 1). The deflection causes the outer portion of each rib 33 to curve upwardly a slight amount as shown in FIG. 2. Each rib 33 rib 33 from support ring 31 is more than twice the thickness of each rib. The thickness and the radial dimensions of each rib 33 should be sufficient to allow permanent deformation as the support ring 31 enters the bore 13, but still be sufficient to provide a great degree of horizontal support to prevent rocking of the wellhead 21 in the housing 11.

The support ring 31 has a protruding rim located above the ribs 33 which has a downwardly facing shoulder 35 that lands on the housing shoulder 15 to support the wellhead 21. Shoulder 35 is frusto-conical to mate with the shoulder 15. The rim of support ring 31 also has an upwardly facing shoulder 37 on its upper end for contacting a shoulder 39 former on wellhead 21. Both shoulders 37 and 39 are frusto-conical. When wellhead 21 initially lands in housing 11, the wellhead shoulder 39 will be in contact with the support ring shoulder 37, as shown in FIG. 1, to support the wellhead 21 in the housing 11. The wellhead shoulder 39 also serves as an upper retaining means for limiting upward movement of the support ring 31 on the wellhead 21 as the wellhead 21 enters the housing 11.

A lower retaining means for limiting movement between the support ring 31 and the wellhead 21 comprises a retaining ring 41. Retaining ring 41 is secured in a groove located below support ring 31 for movement with the the wellhead 21.

When the wellhead 21 is initially inserted into the housing 11, the retaining ring 41 will locate a selected distance below the support ring 31, and the wellhead shoulder 39 will be in contact with the support ring shoulder 37 as shown by the dotted lines 43 and 44. Subsequently if oil at fairly hot temperatures produced from the well flows up the well and through the wellhead 21, the casing 25 may thermally grow. Because the casing 25 is cemented in the well, this results in the wellhead 21 moving upwardly relative to the housing 11. The support ring 31 will remain stationary with the housing 11, providing lateral support for the wellhead 21. At the point of maximum expected thermal growth, shown by the solid lines in FIG. 2, the retaining ring 41 will contact the lower end of the support ring 31.

Referring to FIG. 3, a plurality of vertical grooves or flutes 45 extend through the ribs of the support ring 31. Flutes 45 allow the return of drilling mud when cement is pumped down the casing 25 to cement the casing 25 in the well. FIG. 3 also shows the slot or split 47 in the support ring 31.

Figure 4:
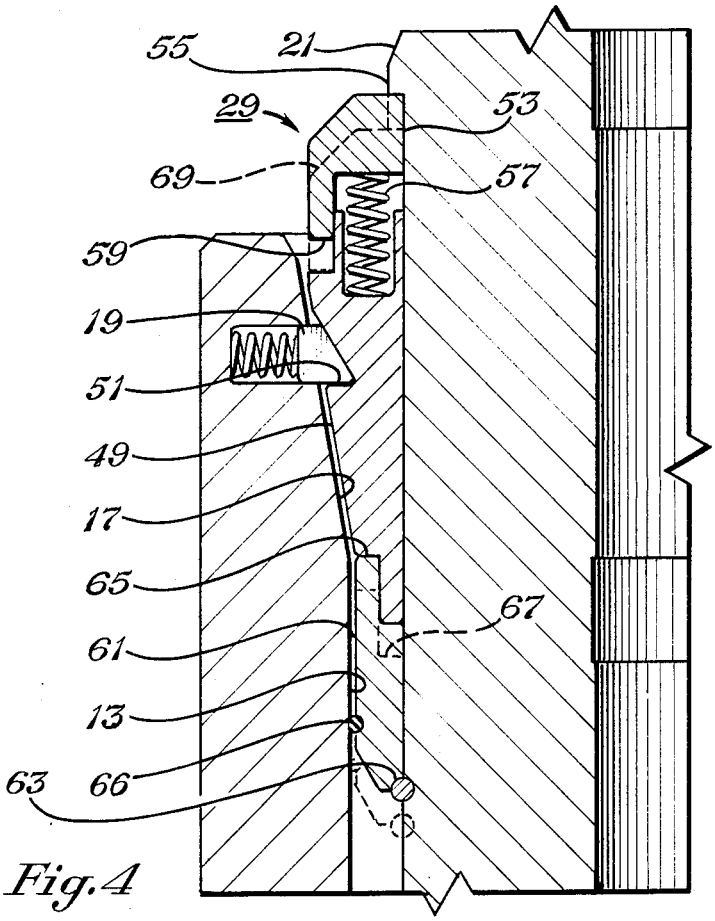
FIG. 4 is an enlarged partial vertical sectional view of the upper support member of FIG. 1.

Referring to FIG. 4, the upper support member comprises a plurality of slips 49. Each of the slips 49 is a wedge-shaped member. The outer wall of each slip 49 is conical. The degree of taper of the outer wall is the same as the degree of taper of the upper edge 17 of the bore 13, causing the slips 49 to wedge as the wellhead 21 is pressed into the housing 11.

Each of the slips 49 has a horizontal groove 51 on its outer wall for receiving the latch 19, which is biased toward the slips 49 by a coil spring. Both the latch 19 and the groove 51 have tapered upper surfaces and horizontal lower surfaces. This causes the latch 19 to snap into the slips 49 as the wellhead 21 enters the housing 11, and prevents upward movement of the slips 49 relative to the housing 11.

An upper retaining collar 53 is located above each of the slips 49. A shoulder 55 on the wellhead 21 prevents upward movement of the collar 53 relative to the wellhead 21. A plurality of coil springs 57 are compressed between the upper collar 53 and the top of the slips 49. The springs 57 urge the slips 49 downwardly on the wellhead 21, and also keep the collar 53 in contact with the shoulder 55. Upper collar 53 has a retaining flange 59 that slidingly retains the upper portion of the slips 49.

A lower retaining collar 61 is screwed to the wellhead exterior below the slips 49. Collar 61 is restrained from downward movement on the wellhead 21 by a snap or retaining ring 63. Collar 61 has an upwardly extending flange 65 that slidingly locates on the outside of a lower portion of the slips 49. A seal 66 located on the outer wall of collar 61 forms a seal against the bore 13 of housing 11. During cementing of the casing 25 (FIG. 1), the cement returns flow through port 18 (FIG. 1) located below the lower collar 61. The seal 66 and the retaining ring 63 prevent entry of the cement returns to the slips 49, so that the slips 49 will remain free floating.

The distance between the flange 59 of the upper collar 53 and the flange 65 of the lower collar 61 is greater than the length of the slips 49 measured at the point of contact with the flanges 59 and 65. This allows some vertical movement of the wellhead 21 relative to the slips 49. As shown by the dotted lines 67 and 69, when the wellhead 21 initially lands in housing, the lower collar 61 will be spaced downward from the lower end of slips 49. The springs 57 will be compressed to a greater extent, and the upper collar flange 59 will be bearing against an upper edge on the slips 49. If thermal growth of casing 25 (FIG. 1) occurs, the wellhead 21 may move upward relative to slips 49 to a maximum position shown by the solid lines in FIG. 4. During the upward movement, the collars 53 and 61 will move upwardly with the wellhead 21 while the slips 49 remain stationary with the housing 11.

In operation, the wellhead 21 is lowered into the housing 11. As the support ring 31 contacts the shoulder 15, the ribs 33 will begin to deflect. Further downward movement causes tight wedging of the wellhead 21 to the housing 11. Simultaneously, at the upper end, the slips 49 will slide into the conical surface 19 and tightly wedge therein. The latch 19 will snap out and lock into the groove 51, shown in FIG. 4. The weight of the casing 25 will be supported by the contact of the support ring 31 against shoulder 15, and the contact of the wellhead shoulder 39 (FIG. 2) on the support ring shoulder 37. The position of wellhead 21 initially upon landing is shown in FIG. 1, and also with the dotted lines in FIGS. 2 and 3.

The casing 25 will be cemented in the well by pumping cement through the wellhead 21 to return up the annulus surrounding the casing 25. Cement returns will flow past the support ring 31 through the flutes 45 (FIG. 3). The returns flow out the port 18 shown in FIG. 1.

The riser conduit (not shown) will be connected to the upper end of the wellhead 21. Lateral movement of the upper end of the riser due to current and wave action will cause bending of riser. The bending movement will be transmitted to the wellhead 21. The lateral forces will transmit through the support ring 31 and the slips 49 to the housing 11. The ribs 33 will reduce rocking movement of the wellhead 21 relative to the housing 11, transmitting lateral forces through them. The greater strength of the housing 11 absorbs the bending forces and reduces the tendency for the wellhead 21 to fatigue and part.

If because of hot well fluids flowing through casing 25, the casing 25 begans to lengthen or grow, wellhead 21 will move upward to a maximum position shown by the dotted line in FIGS. 2 and 3. While moving upward, the support ring 31 and the slips 49 remain stationary with the housing 11. Eventually, the lower retaining ring 41 would contact the support ring 31 as shown in FIG. 2. Also, at the point of maximum growth, the lower collar 61 will bear against the slips 49 as shown in FIG. 4. The maximum growth expected is about three fourths of an inch.

Any additional thermal growth beyond the expected maximum would transmit an upward force through the lower retaining ring 41 and support ring 31 to the housing 11. Before the support ring 31 would slip upward relative to housing 11, the ribs 33 would have to bend back overcenter. This would require a great deal of force, and normally the support ring 31 would be able to resist substantial movement of the wellhead 21 beyond the expected maximum thermal growth.

If the maximum expected thermal growth is exceeded, also an upward force will be transmitted through the lower collar 61 to the slips 49, which would lift from the conical surface 17 and bear against the latch 19. Normally the initial distance between the lower retaining ring 41 and the support ring 31 (FIG. 2), and the initial distance between the lower collar flange 65 and the slips 49 (FIG. 4), will be calculated to be sufficient to accommodate all thermal growth.

The invention has significant advantages. The upper and lower supports transmit bending forces on the wellhead to the housing. The upper and lower supports allow thermal growth of the wellhead to take place without unseating the upper and lower supports.

While the invention has been shown in only one of its forms, it should be apparent to those skilled in the art that it is not so limited, but is susceptible to various changes without departing from the scope of the invention.

We claim:

1. In a subsea well assembly of the type having a tubular housing at the sea floor into which is inserted a tubular wellhead having means on its upper end for connection to riser conduit extending to the surface, an improved means for reducing rocking movement of the wellhead relative to the housing due to bending movement of the riser conduit, comprising:

a metal support member carried by the wellhead, the support member having a plurality of circumferentially extending ribs for engaging an inner wall of the housing, each rib having an outer diameter that prior to engaging the inner wall is greater than the inner diameter of the inner wall of the housing at the point of contact, the support member having a substantially constant inner diameter when mounted to the wellhead, causing the ribs to deflect in an interference fit when the wellhead is inserted into the housing.

2. In a subsea well assembly of the type having a tubular housing at the sea floor having a bore into which is inserted a tubular wellhead having means on its upper end for connection to riser conduit extending to the surface, an improved means for reducing rocking movement of the wellhead relative to the housing due to bending movement of the riser conduit, comprising in combination:

an exterior wall formed on the wellhead and being of a diameter less than the bore, defining an annular clearance between the wellhead and the housing;

an annular metal support ring mounted to the exterior wall of the wellhead and having an inner diameter that is substantially constant and is substantially the same as the exterior wall;

a plurality of circumferentially extending ribs protruding outwardly from the support ring for engaging the bore of the housing, the ribs being parallel to and vertically spaced apart from each other, the outer diameter of each rib being substantially the same as the outer diameter of the other ribs, the outer diameter of the ribs being greater than the diameter of the bore at the point of contact, the support ring being incontractible and inexpansible when mounted to the exterior wall of the wellhead, causing the ribs to deflect in interfering contact with the bore of the housing as the wellhead is lowered into the housing.

3. In a subsea well assembly of the type having a tubular housing at the sea floor having a bore into which is inserted a tubular wellhead having means on its upper end for connection to riser conduit extending to the surface, the improvement comprising in combination:

upper and lower support means mounted to the wellhead and spaced vertically apart for engaging the bore of the housing to reduce rocking movement of the wellhead relative to the housing;

the lower support means comprising a split metal support ring mounted to the exterior of the wellhead, the support ring having a downwardly facing shoulder for landing on an upwardly facing shoulder located in the housing bore, to axially support the wellhead as it lands in the housing;

a plurality of circumferentially extending ribs protruding outwardly from the support ring below the shoulder of the support ring for engaging the bore of the housing, the ribs being parallel to and vertically spaced apart from each other, each rib having upper and lower surfaces that are perpendicular to the axis of the housing prior to engagement of the ribs with the bore of the housing, each of the ribs having an outer cylindrical edge, the outer edge being spaced from the wellhead a distance that is greater than the distance between the wellhead and the housing bore at the point where the ribs contact the bore, causing the ribs to deflect in interference fit with the bore of the housing as the wellhead is lowered into the housing; and a plurality of vertical slots extending through the ribs for the passage of fluid flowing upwardly between the wellhead and housing.

4. In a subsea well assembly of the type having a tubular housing at the sea floor having a bore into which is inserted a tubular wellhead having means on its upper end for connection to riser conduit extending to the surface, the improvement comprising in combination:

upper and lower support means mounted to the wellhead and spaced vertically apart for engaging the bore of the housing;

the lower support means comprising a metal support ring carried by the wellhead, the support ring having a plurality of circumferentially extending ribs for engaging the bore of the housing, each of the ribs having an outer cylindrical edge, the outer edge being spaced from the wellhead a distance that is greater than the distance between the wellhead and the housing bore at the point where the ribs contact the bore, causing the ribs to deflect in an interference fit when the wellhead is inserted into the housing; and retaining means cooperating with each of the upper and lower support means for allowing a selected amount of upward movement of the wellhead relative to the upper and lower support means due to thermal growth.

5. In a subsea well assembly of the type having a tubular housing at the sea floor having a bore into which is inserted a tubular wellhead having means on its upper end for connection to riser conduit extending to the surface, the improvement comprising in combination:

upper and lower support means mounted to the wellhead and spaced vertically apart for engaging the bore of the housing;

the upper support means comprising a plurality of wedge-shaped slips mounted to the wellhead, each of the slips having a tapered outer wall for wedging against a conical surface formed in the bore of the housing;

latch means for preventing upward movement of the slips relative to the conical surface;

upper slip retaining means located on the wellhead above the slips for limiting upward movement of the slips relative to the wellhead as the slips enter the conical surface;

spring means located between the upper slip retaining means and the slips for urging the slips downwardly relative to the wellhead;

lower slip retaining means mounted to the wellhead for movement therewith and spaced below the slips for limiting downward movement of the slips relative to the wellhead prior to contact of the slips with the conical surface, the upper and lower slip retaining means being spaced apart from each other sufficiently to allow a selected amount of upward movement of the wellhead relative to the slips after the latch means engages the slips to accommodate thermal growth;

the lower support means comprising a metal support ring carried by the wellhead, the support ring having a plurality of circumferentially extending ribs for engaging the housing bore, the ribs being parallel to and vertically spaced apart from each other, each of the ribs having an outer cylindrical edge, the outer edge being spaced from the wellhead a distance that is greater than the distance between the wellhead and the housing bore at the point where the ribs contact the bore, causing the ribs to deflect in an interference fit when the wellhead is inserted into the housing; and upper and lower support ring retaining means located on the wellhead above and below the support ring for limiting vertical movement of the support ring relative to the wellhead prior to entry of the wellhead into the housing, the upper and lower support ring retaining means being movable with the wellhead and spaced apart a distance greater than the length of the support ring to allow a selected amount of upward movement of the wellhead relative to the support ring after the support ring has engaged the housing, to accommodate thermal growth.

6. In a subsea well assembly of the type having a tubular housing at the sea floor having a bore into which is inserted a tubular wellhead having means on its upper end for connection to riser conduit extending to the surface, the improvement comprising in combination:

upper and lower support means mounted to the wellhead and spaced vertically apart for engaging the bore of the housing;

the upper support means comprising a plurality of wedge-shaped slips mounted to the wellhead, each of the slips having a tapered outer wall for wedging against a conical surface formed in the bore of the housing;

latch means mounted in the tubular housing for preventing upward movement of the slips relative to the conical surface;

upper slip retaining means located on the wellhead above the slips for limiting upward movement of the slips relative to the wellhead as the slips enter the conical surface;

lower slip retaining means mounted to the wellhead for movement therewith and spaced below the slips for limiting downward movement of the slips relative to the wellhead prior to contact of the slips with the conical surface, the upper and lower slip retaining means being spaced apart from each other sufficiently to allow a selected amount of upward movement of the wellhead relative to the slips after the latch means engages the slips, to accommodate thermal growth of the wellhead relative to the housing; and upper and lower retaining means located on the wellhead above and below the lower support means, for limiting vertical movement of the lower support means relative to the wellhead prior to entry of the wellhead into the housing, the upper and lower retaining means being movable with the wellhead and spaced apart a distance greater than the length of the lower support means to allow a selected amount of upward movement of the wellhead relative to the lower support means after the lower support means has engaged the housing, to accommodate thermal growth of the wellhead relative to the housing.

* * * * *